US008511509B2

(12) United States Patent
Merritt

(10) Patent No.: US 8,511,509 B2
(45) Date of Patent: Aug. 20, 2013

(54) STORAGE ENCLOSURES

(75) Inventor: Paul Merritt, Sussex (GB)

(73) Assignee: Roylan Developments Limited, Surrey (GB)

( * ) Notice: Subject to any disclaimer, the term of this patent is extended or adjusted under 35 U.S.C. 154(b) by 754 days.

(21) Appl. No.: 12/450,883

(22) PCT Filed: Apr. 16, 2008

(86) PCT No.: PCT/GB2008/001328

§ 371 (c)(1),
(2), (4) Date: Oct. 16, 2009

(87) PCT Pub. No.: WO2008/125859

PCT Pub. Date: Oct. 23, 2008

(65) Prior Publication Data

US 2010/0108683 A1 May 6, 2010

(30) Foreign Application Priority Data

Apr. 16, 2007 (GB) ..... 0707305.9

(51) Int. Cl.
*B65D 43/14* (2006.01)

(52) U.S. Cl.
USPC ..... 220/811; 220/324; 220/345.4; 220/558; 220/844; 220/849; 16/345; 312/127; 312/313; 312/323; 312/349

(58) Field of Classification Search
USPC ..... 220/324, 811, 844, 849, 345.4, 558; 16/345; 312/127, 313, 323, 349
See application file for complete search history.

(56) References Cited

U.S. PATENT DOCUMENTS

| | | | | |
|---|---|---|---|---|
| 946,263 | A * | 1/1910 | Palmer | 206/262 |
| 1,848,954 | A * | 3/1932 | Jarvis | 220/319 |
| 2,183,448 | A * | 12/1939 | Drane | 220/203.26 |
| 5,711,053 | A * | 1/1998 | Hafner | 16/380 |
| 6,318,824 | B1 * | 11/2001 | LaGrotta et al. | 312/322 |
| 6,845,875 | B2 * | 1/2005 | Grattan | 220/4.22 |
| 7,062,817 | B2 * | 6/2006 | Lee | 16/334 |
| 2002/0153373 | A1 * | 10/2002 | Traut et al. | 220/4.02 |
| 2005/0224508 | A1 | 10/2005 | Tajiri et al. | |
| 2006/0151354 | A1 | 7/2006 | Dombroski et al. | |

FOREIGN PATENT DOCUMENTS

WO WO 2006/095121 A1 9/2006

* cited by examiner

*Primary Examiner* — Anthony Stashick
*Assistant Examiner* — Elizabeth Volz
(74) *Attorney, Agent, or Firm* — Breiner & Breiner, L.L.C.

(57) ABSTRACT

Enclosure for storing sensitive materials are disclosed. They may be in a special container (1), sealed and purged, replacing the internal atmosphere with an inert purge gas, and leaving the sealed container slightly pressurized. By hinging a lid or door (5) to the container via hinges (12, 13), the respective parts of which can move relative to one another translationally, at least when the door or lid (1) is in the closed position, and in a direction perpendicular to the plane of the door or lid, much improved sealing may be achieved. The invention also relates to methods used to deliver and duct the purge gas within the container to ensure good purge gas delivery and mixing.

5 Claims, 4 Drawing Sheets

STORAGE ENCLOSURES

This application relates to apparatus and methods for storing sensitive materials. In particular, it relates to systems in which sensitive materials are stored in a plurality of containers, each of which may constitute a sealed enclosure preventing the exchange of physical material between the external surroundings of the container, normally the ambient atmosphere, and the contents of the container. The contents are the sensitive material itself together with an appropriate atmosphere. The container may also include, for example, means for supporting the sensitive material itself.

A particular storage problem arises in the pharmaceutical and biotech industries in connection with the transportation and storage of sample materials. Particularly biotechnological materials tend to be unstable and need to be carefully handled. Not only must care be taken not to allow samples to be contaminated by dust, but it is desirable that they are protected from adverse effects from heat sources, light, or exposure to reactive materials such as oxygen or moisture in the atmosphere.

One particular area of substantial concern is the preservation of the small molecule compounds used in pharmaceutical research. These are very often highly sensitive and are conventionally handled and stored as a solution of the compound dissolved in dimethyl sulphoxide. This is a very strong solvent for a very wide range of organic compounds and one, which does not interact chemically with them. On the other hand the material itself, dimethyl sulphoxide, is highly hydrophilic, and accordingly tends to absorb moisture from the ambient atmosphere, which can then interact with the compound in solution in the dimethyl sulphoxide. Accordingly, it is highly desirable to preserve and store such materials even though the sensitive materials are already in solution, in a controlled non-interactive environment because the solution itself can be categorised as a sensitive material.

WO 2006/095121 A1 discloses apparatus and methods for storing sensitive materials. It describes a system consisting of a plurality of portable containers for the storage of sensitive materials, each of which has a plurality of inlet ports, a plurality of exhaust ports, and means for sealing the interior of the container from the outside. These containers are purged with gas to provide a conditioned storage environment that will provide ideal storage conditions for the sensitive materials.

The present invention relates to improvements to the design and construction of the containers.

While the exact configuration of the containers may vary widely, the fundamental requirements are that the interior of the container can be sealed against the outside and that the container has a plurality of inlet ports and outlet ports. It is convenient for many practical industrial applications to produce the containers in a number of standard sizes and the gassing apparatus may include a simple control to adjust the parameters such as gassing time, over-pressure and the like in accordance with the type and size of container in question.

A preferred mode of construction of the containers is that of an open-topped box with a lid or, for larger capacity containers, a box with a door on one side. The walls of the box and the material of the lid or door must be made of gas-impermeable material, for example sheet metal.

The inlet and outlet ports may be mounted on the walls of the box in customary sealed fashion. Preferably both ports are simple one-way or check valves. By providing that the exhaust port has an exhaust valve which opens only when the pressure within the container is above a preset level, the operation of purging the atmosphere from the interior of the container and then pressurising it may be rendered very straightforward.

Preferably the inlet and outlet ports are standard pneumatic ports adapted for cooperating by a quick fit/quick release action with an appropriate fitting on the end of a tube such as a pressure line or exhaust line.

The interior of the containers may be provided if desired with any convenient fittings to assist the storage operation envisaged. For example, the interior may be divided into a number of compartments, for example six compartments in a 3×2 array, into each of which a standard unit may be inserted. For example, in handling biological samples, standard size so-called plate or tube racks are widely used and the storage container may be sized and shaped to enable an array of such racks to be easily accommodated.

Clearly sealing means need to be provided to enable the lid or door to be sealed to the edges of the open-topped box or the side opening respectively. This may be, for example, a resilient rubber or rubber-like material seal around the inside angled corner of a generally tray-shaped lid or door, and means may be provided on the box to enable the lid or door to be firmly held against the box to seal its interior against the ambient atmosphere. Alternatively, the edges of the walls of the box may carry an annular seal strip of U-shaped cross section and made of an appropriate resilient sealing material. Alternatively the sealing faces of the box and the lid or door may be precisely engineered to the extent that a seal may be obtained by clamping these faces together without the need for a separate seal strip or sealing material between these faces.

A gas tight seal between the box and the door or lid is required in order to ensure that the purged environment within the container is maintained at all times without the exchange of gas or other contaminants between the container interior and exterior. Further, the containers are sometimes sealed with a positive pressure following purging, which the seal must also maintain without leakage.

This gas tight seal can be achieved by evenly compressing appropriately designed sealing faces between the edge of the container box and the lid or door. A compressible sealing membrane, such as a silicone seal or another suitable compressible sealing material, may assist sealing.

Using a plurality of latches around the perimeter of the opening in the box to clamp the lid or door on to the box structure is a simple and convenient way of ensuring gas-tightness, by compressing the sealing material or the faces of the box and lid/door tightly together. Such latches have a pivoted actuation tab which carries a swinging bail which engages over a bracket on the lid or door, and which when the tab is swung to lie against the outside wall of the box pulls the lid or door on to the box structure. Such latches are shown in the specification referred to above, identified as clips 5 in the figures. As shown in that specification, the lid is simply physically removed from the box once the sealing latches have been released.

While the lid or door which needs to be opened or removed to enable access to the sensitive materials stored within the box to be achieved may simply be detachable from the box for that purpose, it is preferably hinged to the box structure. This enables the user to access the sensitive materials within the container without the need to physically detach the lid or door from the box. Instead the lid or door may be simply swung into an opened position on one or more hinges, ready to be swung back into a closed position after access to the interior.

However, hinged mounting of the lid or door, whilst improving ease of use, can present problems in achieving an even and effective gas-tight seal. In particular, the presence of a conventional a hinge will restrict the movement of the side of the lid or door to which the hinges are mounted, in a direction perpendicular to the plane of the lid or door.

The problems of achieving an adequate seal between the box and the door or lid, in combination with the optional sealing membrane can theoretically be addressed by engineering the hinge very precisely (and consequently at great expense), so that when door or lid is swung shut it closes precisely and evenly against the box to provide an adequate, and preferably even, seal between the box and the lid or door around the entire perimeter.

According to the present invention, this problem is solved by providing that the two parts of the hinge, in addition to being rotatable one with respect to the other about the hinge axis, can also move, at least when the lid or door is closed, in a direction perpendicular to the plane of the door or lid by an extent necessary to enable tight sealing to be achieved, e.g. by compression of a sealing strip around the periphery of the door or lid.

The present invention accordingly provides a system in which the box is fitted with a door or lid mounted via one, or preferably a plurality of, hinges where the parts of the hinge are configured to provide two degrees of freedom of movement, one rotational and the other translational, allowing the two parts of the hinge to be moved translationally relative to each other, and with a plurality of latches which, when actuated, effect such translational movement. That movement thus allows the lid or door to be moved in and out with respect to the container box doorway, while the rotational movement allows the lid or door to be swung open or shut.

The latches are mounted around part of or the entire door perimeter in convenient positions and provide a clamping force between the container box doorway and the door itself.

The preferred hinge mechanism is one in which a hinge pin fits tightly in a cylindrical channel in one hinge part and loosely in a widened channel in the other. Instead of cylindrical holes in one of the set of blades which can be interleaved between another set of blades on the other hinge part, the holes on that other hinge part are configured as slots. Using such "slotted" hinges with the latches placed around the box perimeter provides a container box, lid or door, latch and hinge combination that enables the lid or door to be evenly clamped shut. The parts of the slotted hinges are free to move relative to one another as the latches are fastened.

The present invention, in another aspect, addresses the problem of securing adequate and efficient purging of the interior of the container. When purging a container with purge gas it is important to ensure that the incoming purge gas is well distributed within the container. This is to ensure good gas mixing so that the container may be fully and efficiently purged.

This will involve delivering purge gas to the far side of the container relative to the container inlet and/or outlet ports, and into confined spaces within the container where purge gas may mix poorly with the gas within the container needing to be purged out. An obvious delivery method to duct the purge gas within the enclosure is to provide a delivery tube within the container connected to the purge gas input port. However, this delivery tube is an added item that needs to be manufactured and fitted in place, increasing the complexity, cost and potentially the size of the container.

As described above the interior of the container may be fitted with suitable supporting compartments to hold the sensitive materials within the container.

The present invention provides, in another aspect, that the purge gas within the container is directed, by appropriately designing the supporting compartments, throughout the container to ensure good gas mixing throughout the container interior. The supporting compartments themselves act as a ducting system to direct the purge gas.

This may be achieved in various ways. As an example, the supporting compartments may be made of sheet metal, configured, formed, worked and joined to provide not only a suitable support structure for the sensitive materials, but one where the purge gas flow around them is distributed well.

Forming of the sheets of material may involve bending of the sheet material to create complex shapes. Joining of the formed sheets of material may be achieved by removing shapes of material from the sheet, allowing formed sheets to be joined and locked together by sliding formed sheets into each other using the cut-outs created in the formed sheets. In addition joining of the formed sheets may be achieved by welding, bonding or applying mechanical fixings such as rivets or screws.

Design technique should be adopted to allow structures to be created that feature a plurality of supporting compartments for the sensitive materials as well as providing, often in combination with the walls of the container once the structures have been installed therein, ducting to direct the purge gas appropriately. As an example a structure of supporting compartments could be designed:

With horizontally positioned formed sheets of material; and

Vertically positioned formed sheets of material; where

The sheets are slotted together to create a matrix structure of a plurality of supporting compartments; where Excess material from the matrix structure of the supporting compartments is designed to protrude from the exterior of the matrix structure of supporting compartments, creating channels around the exterior of the matrix structure of supporting compartments; and Excess material around the edges of the horizontally and vertically formed sheets of material is bent and formed to create additional channels; creating Channels around the exterior of the matrix structure of supporting compartments, which if butted up to the inside face of the container box will create closed ducting; which If positioned directly in line with purge gas inlet and outlet ports will allow purge gas to be directed and ducted around the container interior.

The accompanying drawings illustrate one way of putting the invention into practice.

Figure 1:
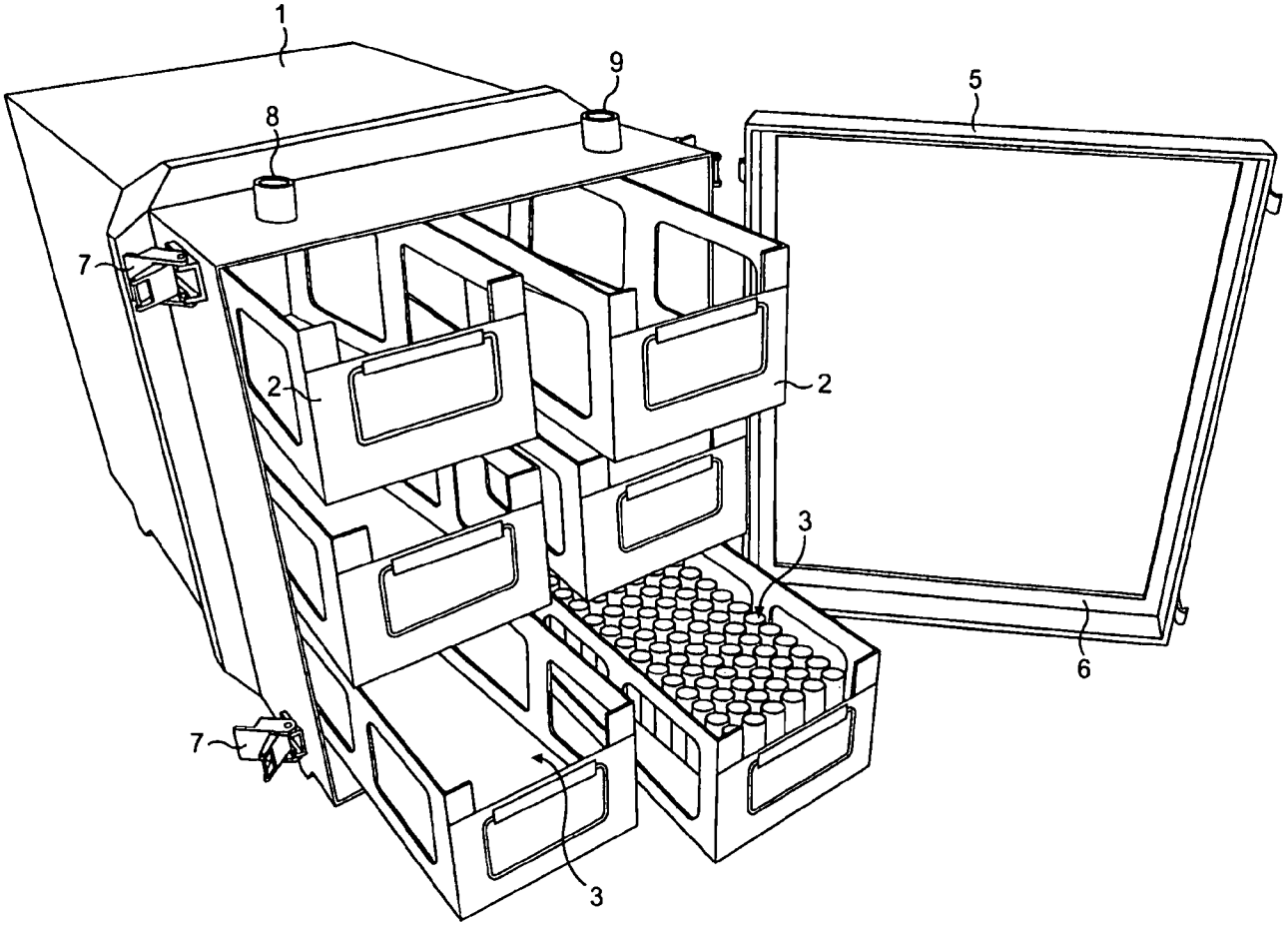
FIG. 1 is a diagrammatic perspective view of a container according to the invention.

As shown, the container consists of a sheet steel box 1, open at one end. Internally of the box are support structures for supporting a number of sheet metal trays 2 each of which can be loaded with racks 3 of sample materials which need to be preserved in a stable protective atmosphere. Hinged to the side of box 1 is a door 5, having an internal sealing strip 6 around its inner periphery. Latches 7 are mounted on the sides of box 1 to enable the door 5 to be fastened tightly against the open end of the box 1.

Mounted in the top wall of the box are inlet and outlet ports 8,9 for purge gas.

Figure 2:
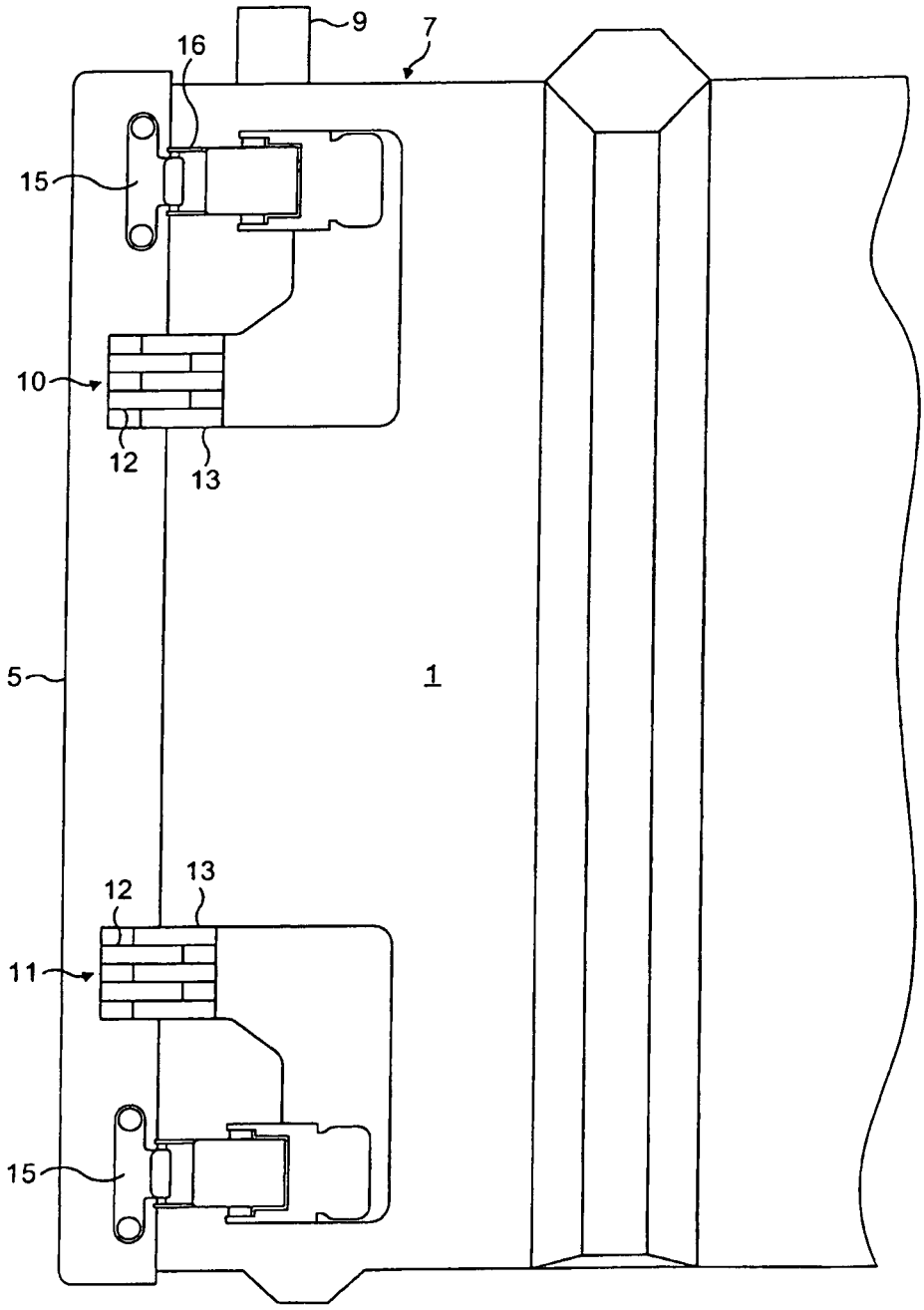
FIG. 2 is a side view of part of the container, showing the hinged side of the door.
Figure 3:
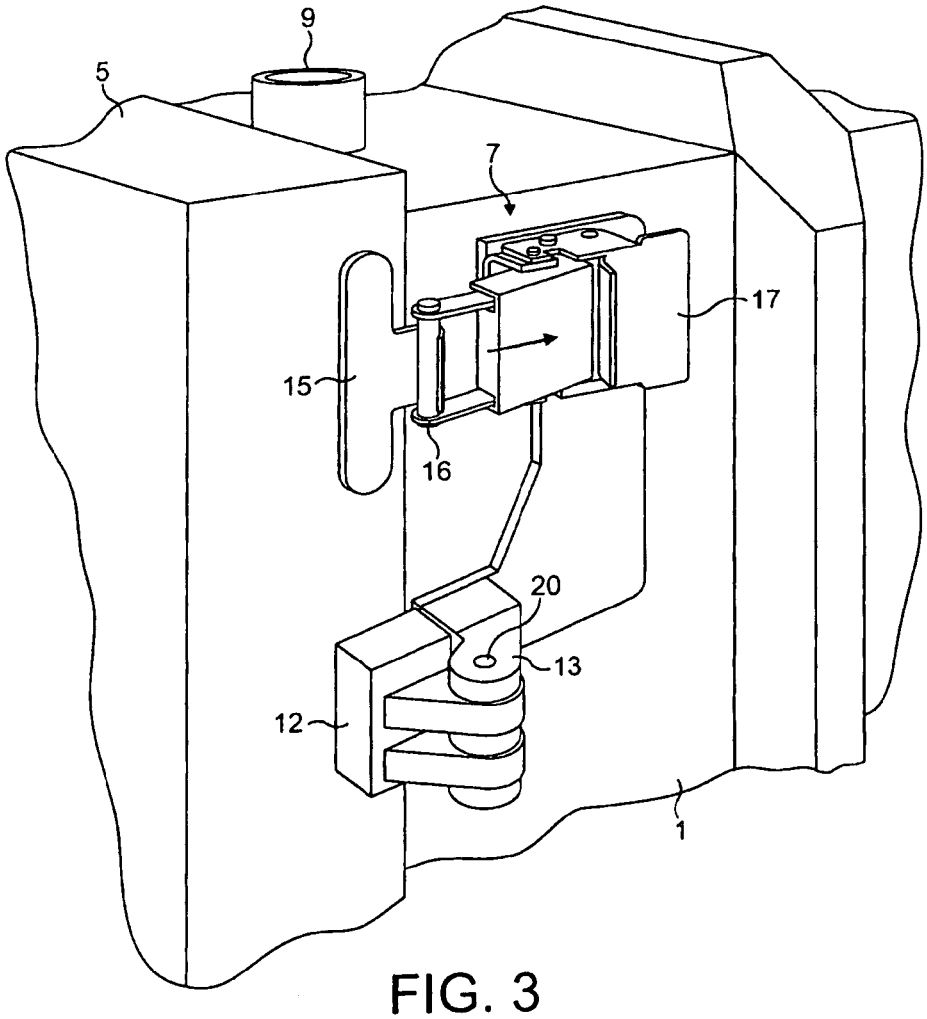
FIG. 3 is an enlarged view of one of the hinges.

As shown in FIG. 2, the door 5 is mounted on two hinges 10,11. Each consists of a part 12 fixed to the edge of the door, a part 13 fixed to the side of box 1, and a hinge pin 20 passing through apertures in the interleaved blades of posts 12 and 13. Also mounted on door 5 are two brackets 15 over which a bail 16 forming part of a closure latch 7 may be swung. The bail may be pulled in the direction shown by the arrow on FIG. 3 as an actuation tab 17 is swung down against the side of box 1, so compressing the seal strip 6 firmly and evenly against the edge of the box 1.

Figure 4:
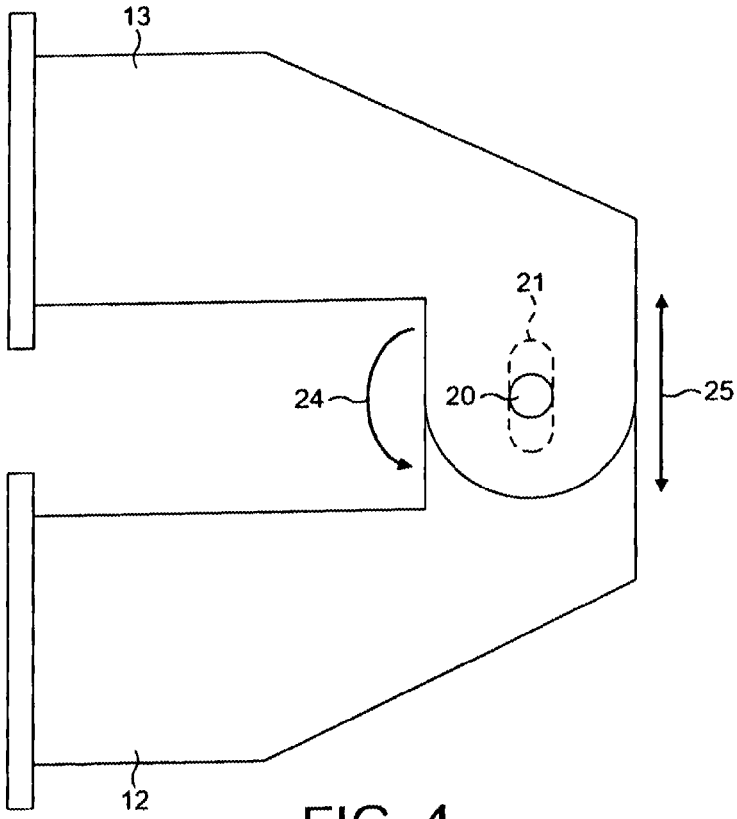
FIG. 4 is a diagram showing the hinge construction.

FIG. 4 shows diagrammatically how hinge pin 20 is located. It passes through circular holes in the blades forming part of part 13 of the hinge, and is a tight fit therein so it does not drop out of the hinge. However, in the blades forming part of part 12, instead of the circular holes, there is a slot indicated by dashed lines 21 in FIG. 4. The slot extends in a direction perpendicular to the plane of door 5. This arrangement enables the hinge to allow the door to swing open and closed, rotating about pin 20, as shown by arrow 24. When the door is in the closed position, however, it can be drawn tightly against the edge of box 1 or released therefrom by using the latches 7, with the parts of the hinge moving translationally with respect to one another in the direction of arrow 25.

Although the container illustrated has a single door, it is possible to conceive of containers with more than one door if desired, at least one of the doors being mounted via hinges of the construction shown in FIG. 4. This hinge construction is believed to be novel and as such constitutes a further feature of the invention.

The invention claimed is:

1. A storage enclosure comprising a sealable box having an open face fitted with at least one door or lid, said at least one door or lid being mounted via at least one hinge, wherein component parts of a hinge of said at least one hinge are attached respectively to said box and said at least one door or lid and are configured to provide a first degree of freedom of movement which is rotational and a second degree of freedom of movement which is translational, allowing the component parts of the hinge to be moved translationally relative to each other, and the box including a plurality of latches mounted around a perimeter of the open face of the box which, when actuated, effect translational movement of the component parts of the hinge one relative to another to seal the at least one door or lid closed against the box, and said box including inlet and outlet ports located on the box to enable purge gas to be passed through the storage enclosure, and further including a plurality of supporting compartments within the box.

2. The storage enclosure according to claim 1, wherein the hinge has a first part fitted to the at least one door or lid, and a second part fitted to the box, the first part and the second part being held together via a hinge pin which fits tightly in a cylindrical channel in one of the first part or the second part and loosely in a widened channel present in the first part or the second part not including the cylindrical channel.

3. The storage enclosure according to claim 2, wherein the first part and the second part each has a set of parallel blades of spacing substantially equal to a width of each blade and which are interleaved to assemble the hinge, each of said blades having a cylindrical hole or slot through which the hinge pin passes.

4. The storage enclosure according to claim 1, further including a resilient or compressible seal strip mounted on an edge of the box against which the at least one door or lid fits and/or is mounted on parts of the at least one door or lid which abut the box when the at least one door or lid is closed.

5. The storage enclosure according to claim 1, wherein the supporting compartments are adapted to serve as a ducting system.

* * * * *